US010531696B2

(12) United States Patent
Achtymichuk

(10) Patent No.: US 10,531,696 B2
(45) Date of Patent: Jan. 14, 2020

(54) OPTIMAL RANGE OF MOTION GARMENT UTILIZING SLEEVE OPENINGS AND GUSSETS

(71) Applicant: Nike, Inc., Beaverton, OR (US)

(72) Inventor: Amie J. Achtymichuk, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/158,410

(22) Filed: Jan. 17, 2014

(65) Prior Publication Data

US 2014/0201883 A1 Jul. 24, 2014

Related U.S. Application Data

(60) Provisional application No. 61/754,840, filed on Jan. 21, 2013.

(51) Int. Cl.
*A41D 27/10* (2006.01)
*A41D 1/04* (2006.01)

(52) U.S. Cl.
CPC ..... *A41D 27/10* (2013.01); *A41D 1/04* (2013.01)

(58) Field of Classification Search
CPC .... A41D 13/0015; A41D 27/00; A41D 27/10; A41D 1/04; A41D 1/00; Y10S 2/04; A41B 1/08; A41B 1/00
USPC ..... 2/462, 463, 69, 115, DIG. 2, 125, 93, 2/108, 81
See application file for complete search history.

(56) References Cited

U.S. PATENT DOCUMENTS

| | | | | |
|---|---|---|---|---|
| 1,679,206 | A * | 7/1928 | Crossingham | 2/113 |
| 2,839,756 | A * | 6/1958 | Geiss | A41D 27/10 2/125 |
| 3,037,210 | A * | 6/1962 | Neuman | 2/125 |
| 3,078,699 | A * | 2/1963 | Huntley | 66/176 |
| 4,473,908 | A * | 10/1984 | Knecht | 2/115 |
| 4,698,849 | A * | 10/1987 | Mitchell et al. | 2/115 |
| 5,349,704 | A * | 9/1994 | Masters | 2/115 |
| 7,891,021 | B2 * | 2/2011 | Grilliot et al. | 2/81 |
| D661,054 | S * | 6/2012 | Minamijima | D2/717 |

(Continued)

FOREIGN PATENT DOCUMENTS

| | | | |
|---|---|---|---|
| FR | 2677855 | * 12/1992 | A41D 13/00 |

OTHER PUBLICATIONS

Patent Translate Powered by EPO and Google, Translation of FR2677855, Mar. 29, 2016, Espacenet Patent Search, pp. 1-2.*

(Continued)

*Primary Examiner* — Alissa J Tompkins
*Assistant Examiner* — Brieanna Szafran
(74) *Attorney, Agent, or Firm* — Shook Hardy & Bacon, LLP

(57) ABSTRACT

An optimal range of motion garment is provided. The garment is capable of fitting over one or more shoulder pads. The garment comprises a front portion attached to a sleeve, a back portion attached to a sleeve, and a gusset attached to the front portion and the back portion. The gusset is configured to correspond to a negative space of the one or more shoulder pads. The garment may also comprise a sleeve opening attached to the sleeve. The sleeve opening is directed towards the front of a user at a specific angle. The gusset and sleeve opening being directed towards the front portion at a specific angle facilitate optimal range of motion for a user.

15 Claims, 6 Drawing Sheets

(56) References Cited

U.S. PATENT DOCUMENTS

| | | | | |
|---|---|---|---|---|
| D698,124 | S * | 1/2014 | Yu | D2/840 |
| 2001/0025387 | A1 | 10/2001 | Suga et al. | |
| 2004/0016041 | A1* | 1/2004 | Uno | A41B 9/06 2/113 |
| 2004/0221362 | A1* | 11/2004 | Bosne et al. | 2/93 |
| 2007/0028351 | A1 | 2/2007 | Coolik | |
| 2007/0079419 | A1 | 4/2007 | Spruill | |
| 2007/0271671 | A1* | 11/2007 | Okajima | A41D 1/04 2/69 |
| 2008/0060113 | A1 | 3/2008 | Walsh | |
| 2009/0025115 | A1* | 1/2009 | Duffy et al. | 2/69 |

OTHER PUBLICATIONS

European Search Report dated May 19, 2016 for European Patent Application No. 14760145.4, 7 pages.
Office Action dated Feb. 7, 2017 in European Patent Application No. 14760145.4, 5 pages.
Office Action dated Jul. 27, 2017 in European Patent Application No. 14760145.4, 3 pages.
Extended Search Report dated Feb. 12, 2019 in European Patent Application No. 18181473.2, 12 pages.
Partial Search Report dated Oct. 29, 2018 in European Patent Application No. 18181473.2, 13 pages.

* cited by examiner

FIG. 6.
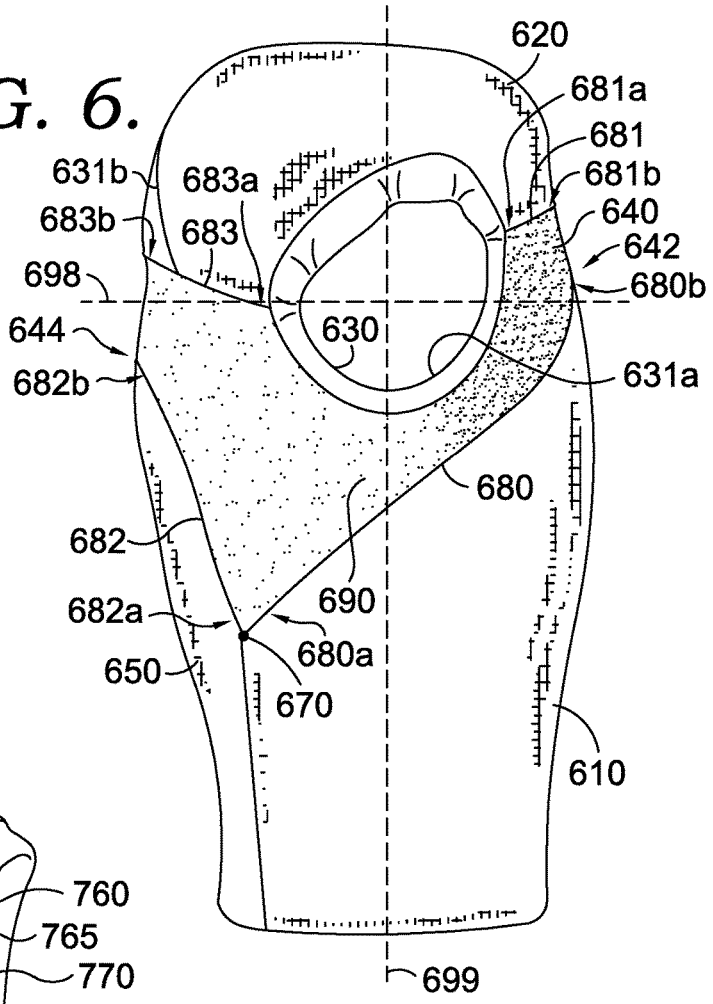
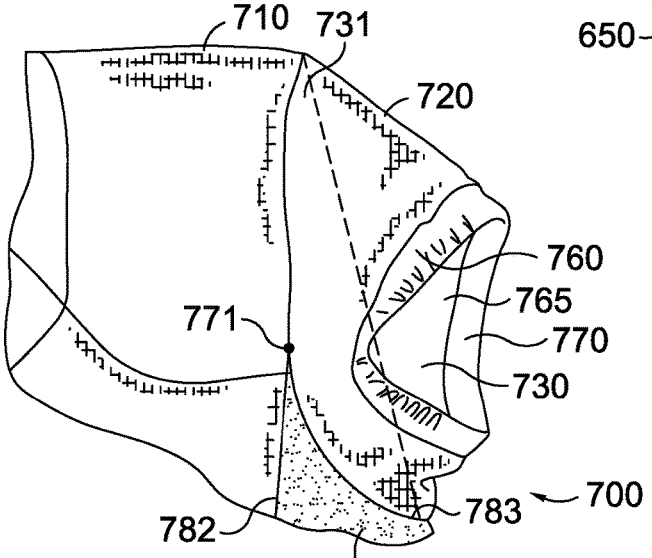
FIG. 7.
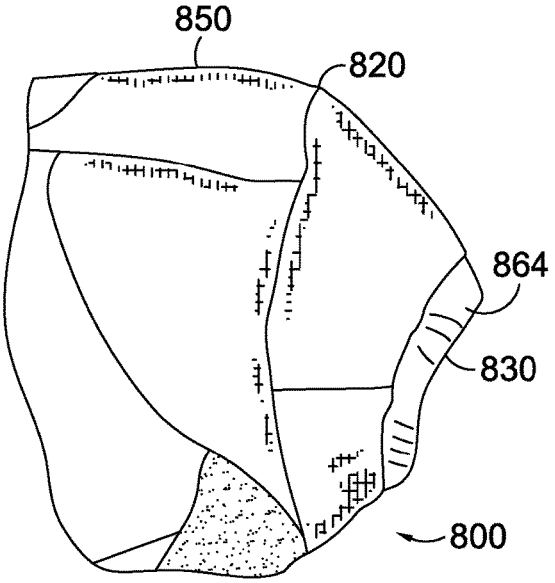
FIG. 8.

OPTIMAL RANGE OF MOTION GARMENT UTILIZING SLEEVE OPENINGS AND GUSSETS

CROSS REFERENCE TO RELATED APPLICATIONS

The present application claims the benefit of U.S. Provisional Patent Application No. 61/754,840, filed Jan. 21, 2013 and entitled "OPTIMAL RANGE OF MOTION GARMENT UTILIZING SLEEVE OPENINGS AND GUSSETS," which is incorporated by reference in its entirety.

TECHNICAL FIELD

The present invention relates to an optimal range of motion garment. More particularly, the present invention relates to a garment that utilizes strategically configured sleeve openings and gussets to provide a wearer an optimal range of motion.

BACKGROUND AND SUMMARY

Generally, the majority of every day movements of a user involve the user utilizing their arms on the front-side of the user, and therefore on the front portion of a garment. However, despite the majority of arm movement taking place closer to the front of the user, conventional garments include a sleeve opening centered between a front portion and a back portion of the garment. The placement and configuration of the sleeve opening in conventional garments restrict a user's arm mobility. A user's arm mobility is particularly important in the field of sports, as athletes require an extensive range of arm movements and mobility in order to perform optimally.

Exemplary aspects of the present invention are defined by the claims below, not this summary. A high-level overview of various aspects of the invention are provided here for that reason, to provide an overview of the disclosure, and to introduce a selection of concepts that are further described in the detailed-description section below. This summary is not intended to identify key features or essential features of the claimed subject matter, nor is it intended to be used as an aid in isolation to determine the scope of the claimed subject matter.

At a high level, subject matter described herein includes exemplary aspects of a garment that facilitates an optimal range of motion. Exemplary aspects of the present invention include sleeve openings that are angled towards a front portion of a garment and located substantially more on the front portion of the garment than on the back portion of the garment, allowing for a user to have a broad range of motion. Additionally, exemplary aspects of the present invention concern gussets configured to correspond to a negative space of one or more shoulder pads. Such use of gussets facilitates a broad range of motion for a user of the garment including, for instance, four way stretching.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

Illustrative embodiments of the present invention are described in detail below with reference to the attached drawings figures, and wherein:

FIG. 6 is a side perspective view of an exemplary embodiment of an optimal range of motion garment, in accordance with aspects herein;

FIG. 7 is a perspective view of an exemplary embodiment of an optimal range of motion garment, in accordance with aspects herein;

FIG. 8 is a perspective view of an exemplary embodiment of an optimal range of motion garment, in accordance with aspects herein;

DETAILED DESCRIPTION

Figure 1:
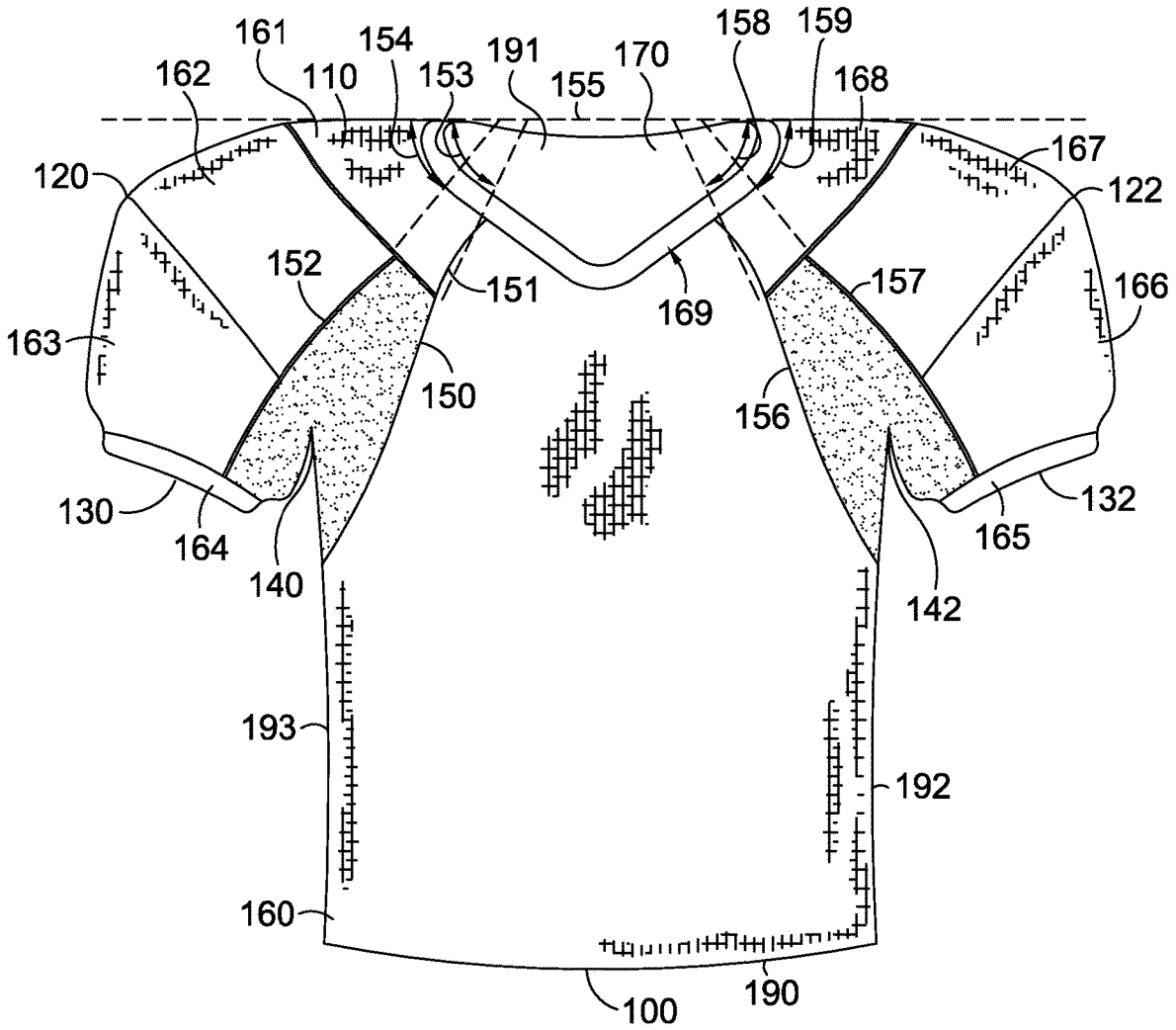
FIG. 1 is a front perspective view of an exemplary embodiment of an optimal range of motion garment, in accordance with aspects herein.

The subject matter of the present invention is described with specificity herein to meet statutory requirements. However, the description itself is not intended to limit the scope of this patent. Rather, the inventor has contemplated that the claimed subject matter might also be embodied in other ways.

Accordingly, at least one aspect herein relates to an enhanced mobility shirt comprising a front panel an opposite back panel, a sleeve panel and a gusset. The sleeve panel may be connected to at least a portion of the front panel and at least a portion of the back panel and may form at least a first portion of a sleeve. The gusset may be connected to at least a portion of the front panel, at least a portion of the back panel, and at least a portion of the sleeve panel and form at least a second portion of the sleeve.

Another aspect herein may relate to an enhanced mobility shirt comprising a front panel an opposite back panel, a sleeve panel, a gusset, and a sleeve opening. The sleeve panel may be connected to at least a portion of the front panel and at least a portion of the back panel and may form at least a first portion of a sleeve. The gusset may be connected to at least a portion of the front panel, at least a portion of the back panel, and at least a portion of the sleeve panel and form at least a second portion of the sleeve. The sleeve may comprise a proximal sleeve opening and a distal sleeve opening. The distal sleeve opening may be more anterior than the proximal sleeve opening allowing for the sleeve to be an anterior-oriented sleeve in an at-rest configuration.

Garments in accordance with aspects herein may be constructed of a variety of types of textiles, either woven or knit. Examples of types of fibers that may be used in constructing garments in accordance with the present invention are polyester, nylon, cotton, spandex, and/or blends of these and/or other fibers. Each panel of a garment herein may be comprised of materials different from other panels and may be attached to another panel through stitching, sewing, riveting, and other similar known methods may be implemented. Additional examples may include adhesives or other chemical processes. A panel may be mesh or solid material. The type of material a panel comprises may affect a range of motion as materials may vary in elasticity. Each panel may comprise more than one modulus of elasticity. For example, a gusset may comprise a first modulus of elasticity and a second modulus of elasticity, where the first modulus of elasticity is different from the second modulus of elasticity. The first modulus of elasticity may be located on a front portion of a gusset on a front portion of garment. The second modulus of elasticity may be located on a back portion of the gusset on aback portion of the garment. The type of material, elastic modulus, seam construction, and other aspects of each panel configuration may depend on type of sport and type of athlete and/or activities a wearer may engage in.

Referring now to FIG. 1, an exemplary garment 100 is shown, in accordance with aspects herein. Garment 100 comprises a back portion (not shown) connected to a front portion 110. Garment 100 also includes sleeves 120 and 122, each with sleeve openings 130 and 132. The sleeves 120 and 122 are both connected to the back portion and front portion 110. Further, the front portion 110, back portion and sleeves 120 and 122 of garment 100 comprise panels 140, 142, 160, 161, 162, 163, 164, 165, 166, 167, 168, 169 and 170. Panel 160 is located on the front portion 110 between panels 140, 142, and 169. Panel 170 is located on the back portion between panels 140. 142, and 169. Panels 140 and 142 are gussets located between panel 160 and panels 162, 163, 166 and 167, respectively, that bridge between the back portion and the front portion 110. Specifically, gussets 140 and 142 may be located on the front portion 110, back portion, and sleeves 120 and 122, respectively. Panels 161, 162, 163, 154, 165, 166, 167, 168, and 169 may also extend from the front portion 110 to the back portion.

In some aspects, panels located on the front portion 110 of garment 100 may be referred to as a front panel. In some aspects, a front panel may refer to all panels that are located on front portion 110. In other aspects a front panel may refer to at least a portion of one, two, or more panels that are located on front portion 110, such as panels 160 162, and 167, for instance. Similarly, panels located on the back portion may be referred to as a back panel. In some aspects, a back panel may refer to all panels that are located on the back portion. In additional aspects a back panel may refer to at least a portion of one, two, or more panels that are located on the back portion. Panels located on a sleeve, such as sleeve 120 and/or 122, may be referred to as a sleeve panel. In some aspects, all panels located on a sleeve may be referred to as a sleeve panel. In other aspects, a sleeve panel may refer to at least a portion of one, two, or more panels located on a sleeve.

Each gusset may be configured having various angles, orientations, configurations, shapes, and the like on garment 100. For reference purposes in describing the various angles associated with a gusset located on the front portion 110 of garment 100, an axis 155 has been provided at the top portion of front portion 110 and back portion of garment 100. Additionally, line 150 (e.g., a seam) located between gusset 140 and panel 160 is extended for reference purposes as a dotted line and line 152 located between gusset 140 and panels 162 and 163 is extended as a dotted line to meet a reference axis 155 forming angles 153 and 154. Angle 153 is associated with line 150 and angle 154 is associated with line 152. Extending from line 150 is a line 151, which forms an edge of panel 161. Similarly, line 156 located between gusset 142 and panel 160 is extended as a dotted line and line 157 located between gusset 142 and panels 166 and 167 is extended as a dotted line to meet axis 155 forming angles 158 and 159. Angle 158 is associated with line 156. Angle 159 is associated with line 157. Angles 153, 154, 158 and 159 may be different from one another and vary from zero to 180 degrees facilitating varying ranges of mobility. Each angle allows a gusset to provide varying ranges of motions to a user wearing garment 100.

Figure 2:
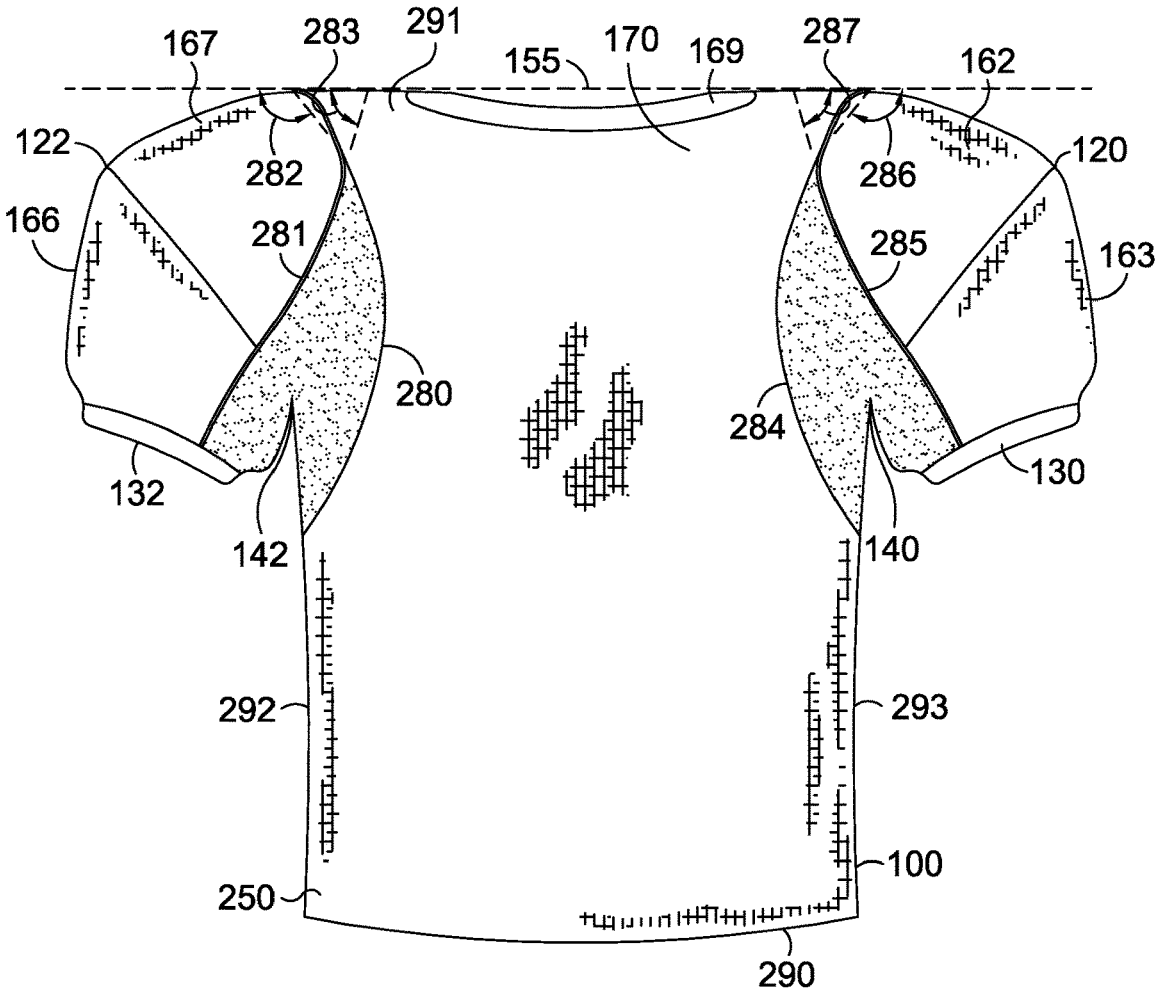
FIG. 2 is a back perspective view of an exemplary embodiment of an optimal range of motion garment, in accordance with aspects herein.

A back side view of exemplary garment 100 is shown in FIG. 2, in accordance with aspects herein. As described above, garment 100 comprises a back portion 250, front portion (not shown), and sleeves 120 and 122 comprising panels 140, 142, 160, 161, 162, 163, 164, 165, 166, 167, 168, 169, and 170. As described above, each gusset may be configured at various angles on garment 100. For reference purposes in describing the various angles associated with a gusset located on the back portion 250 of garment 100, axis 155 has been provided at the top portion of front portion and back portion 250 of garment 100. Additionally, line 280 located between gusset 142 and panel 170 is extended as a dotted line and line 281 located between gusset 142 and panels 167 and 166 is extended as a dotted line to meet axis 155 forming angles 282 and 283. Angle 282 is associated with line 280. Angle 283 is associated with line 281. Similarly, line 284 located between gusset 140 and panel 160 is extended as a dotted line and line 285 located between gusset 142 and panels 162 and 163 is extended as a dotted line to meet axis 155 forming angles 286 and 287. Angle 286 is associated with line 284. Angle 287 is associated with line 285. Angles 282, 283, 286 and 287 may be different from one another and vary from zero to 180 degrees facilitating varying ranges of mobility. Each angle allows a gusset to provide varying ranges of motions to a user wearing garment 100.

As sleeves 120 and/or 122 are described as being connected to the back portion 250 and front portion 110, of FIG. 1 accordingly a sleeve panel may be connected to the back portion 250 and front portion 110 of FIG. 1. In some aspects, a sleeve panel may be described as being connected to at least a portion of the front panel and at least a portion of the back panel. In some aspects, a sleeve panel may form at least a first portion of a sleeve. In some aspects, a front panel may comprise a front top portion 191, a front bottom portion 190, a front first side portion 192, and a front second side portion 193, as defined in FIG. 1. A back panel may comprise a back top portion 291, a back bottom portion 290, a back first side portion 292, and a back second side portion 293. A sleeve panel may be connected to at least a portion of the front top portion 191 and at least a portion of the back top portion 291. Additionally, a sleeve panel may define at least a portion of a sleeve opening, such as sleeve opening 130 and/or 132.

In additional aspects, a gusset may form at least a second portion of a sleeve. A gusset may be connected to at least a portion of the front panel, at least a portion of the back panel, and at least a portion of the sleeve panel. A gusset may be connected to at least a portion of the front top portion 191 of FIG. 1, at least a portion of the back top portion 291, at least a portion of the back first side portion 292 and/or at least a portion of the back second side portion 293, at least a portion of the front first side portion 192 of FIG. 1 and/or at least a portion of the front second side portion 193 of FIG. 1, and at least a portion of the sleeve panel. Additionally, a gusset may define at least a portion of a sleeve opening, such as a distal sleeve opening 130 and/or 132.

Figure 3:
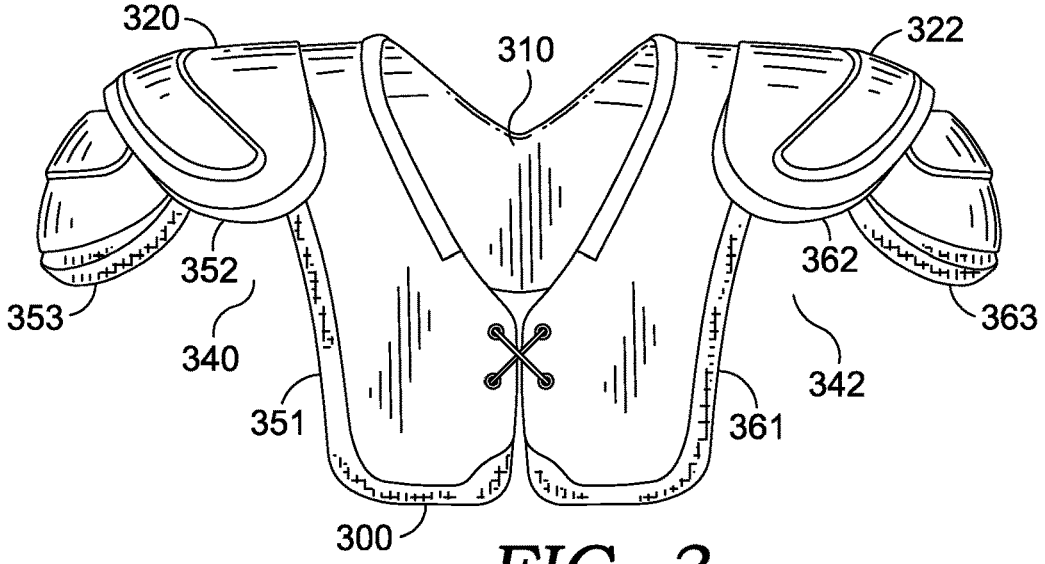
FIG. 3 is an exemplary diagram of a set of shoulder pads, in accordance with aspects herein.

Referring now to FIG. 3, an exemplary set of shoulder pads 300 is shown, in accordance with aspects herein. Shoulder pads 300 comprise a front portion 310, back portion, and shoulder pads 320 and 322. As shown in FIG. 3, there exist negative spaces 340 and 342 located between the front portion 310, back portion, and each of the shoulder pads 320 and 322, respectively. Specifically, a portion of negative space 340 is located between lines 351, 352, and 353. Negative space 342 is located between 361, 362, and 363. Portions of negative spaces 340 and 342 are also located between the back portion and shoulder pads 320 and 322. Gussets 140 and 14 of FIG. 2 may be configured to correspond to each of the negative spaces 340 and 342. Shoulder pads 300 are exemplary shoulder pads. Additional shoulder pads that aspects of the present invention may be capable of fitting over include, but are not limited to, athletic shoulder pads associated with football, hockey, rugby and/or any other sports activities that utilize shoulder pads. Additionally, embodiments of the present invention may be capable of fitting over non-athletic shoulder pads. Gussets may be configured to specifically correspond to each of a variety of negative spaces associated with a variety of shoulder pads. The angles associated with each gusset may be configured to allow a gusset to correspond with a negative space of a variety of shoulder pads and/or other comparable garments.

Figure 4:
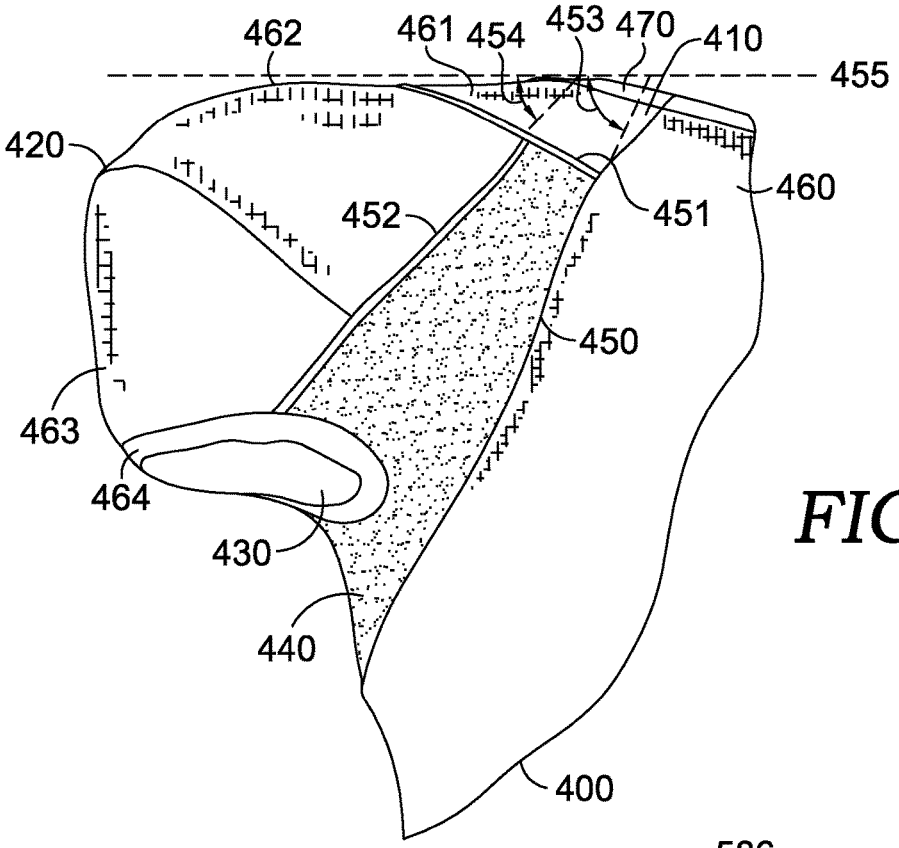
FIG. 4 is a perspective view of an optimal range of motion garment, in accordance with aspects herein.

Referring to FIG. 4, a portion of an exemplary garment 400 is shown, in accordance with aspects herein. Similar to garment 100 of FIG. 1 and FIG. 2, garment 400 comprises a back portion connected to a front portion 410. Garment 400 includes sleeves, such as sleeve 420, each sleeve having a sleeve opening, such a sleeve opening 430. Sleeve opening 420 may be connected to the back portion and front portion 410. Garment 400 additionally includes gussets, such as 440. Gussets may bridge between a back portion and a front portion of a garment. For instance, gusset 440 may bridge between a back portion and front portion 410 and provide enhanced mobility. FIG. 4 shows garment 400 fitted over a set of shoulder pads, such as shoulder pads 300 of FIG. 3 such that a gusset, such as gusset 440, may correspond to negative spaces, such as negative spaces 340 and/or 342 of shoulder pads 300 of FIG. 3. For reference purposes in describing the various angles associated with a gusset located on the front portion 410 of garment 400 an axis 455 has been provided at the top portion of front portion 410 and back portion of garment 400. Additionally, line 450 (e.g. sewn seam, molded seam, bonded seam) located between gusset 440 and panel 460 is extended as a dotted line and line 452 located between gusset 440 and panels 462 and 463 is extended as a dotted line to meet axis 455 forming angles 453 and 454. Angle 453 is associated with line 450 and angle 454 is associated with line 452. Angles 453 and 454 may be different from one another or the same and may vary from zero to 180 degrees facilitating varying ranges of mobility. The angles associated with each gusset may be configured to allow a gusset to correspond with a negative space. Certain angles provide greater ranges of motion than others, and some ranges of movement may be more desirable for particular sports or activities.

Figure 5:
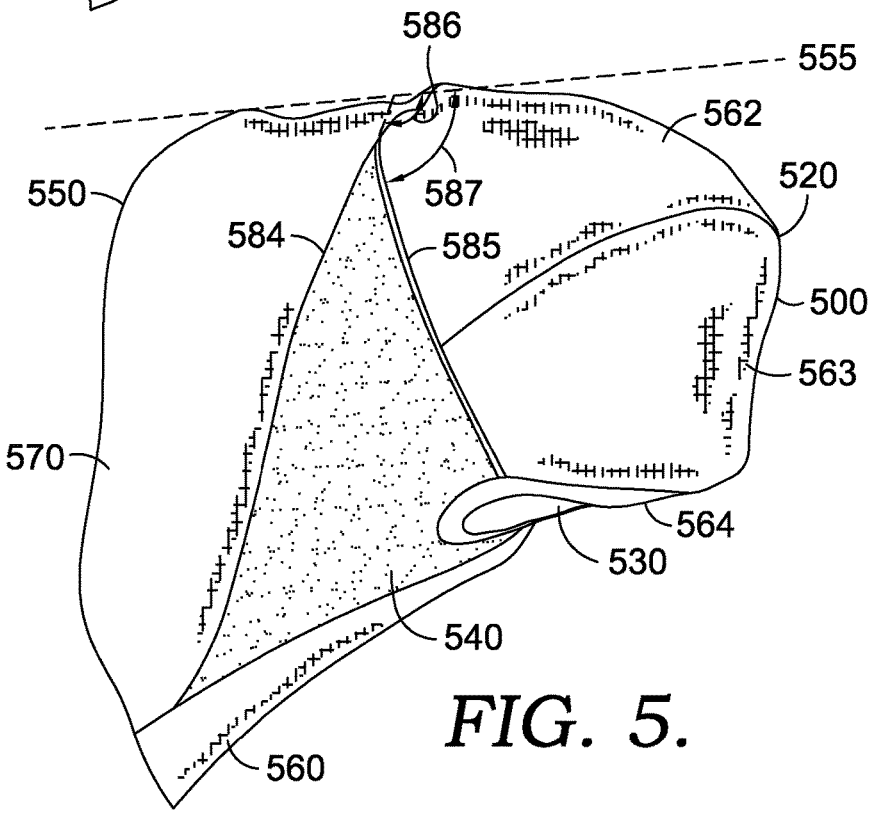
FIG. 5 is a perspective view an optimal range of motion garment, in accordance with aspects herein.

FIG. 5 shows a portion of an exemplary garment 500, similar to garment 400 of FIG. 4, as fitted over a set of shoulder pads, similar to shoulder pads 300 of FIG. 3, in accordance with aspects herein. Garment 500 comprises a front portion connected to a back portion 550. Garment 500 also includes sleeves 520 and 522 (not shown), each with sleeve openings, such as a distal sleeve opening 530. Sleeve 520 may be connected to the front portion and back portion 550. Garment 500 additionally includes gussets, such as a gusset 540. Gusset 540 bridges between the front portion and the back portion 550. For reference purposes in describing the various angles associated with a gusset located on the back portion 550 of garment 500, axis 555 has been provided at the top portion of front portion and back portion 550 of garment 500. A line 584 located between gusset 540 and panel 570 is extended as a dotted line to meet axis 555 forming angle 586. Line 585 is located between gusset 540 and panels 562 and 563 and is associated with angle 587. Angles 586 and 587 may be different from one another or the same and may vary from zero to 180 degrees facilitating varying ranges of mobility. The angles associated with each gusset may be configured to allow a gusset to correspond with a negative space of a variety of shoulder pads. Certain angles provide greater ranges of motion than others, and some ranges of movement may be more desirable for particular sports or activities.

FIG. 6 provides a portion of a perspective view of an exemplary garment 600, similar to garment 500 of FIG. 5, as fitted over a set of shoulder pads, similar to shoulder pads 300 of FIG. 3, in accordance with aspects herein. Garment 600 comprises a front portion 610 connected to a back portion 650. Garment 600 also includes sleeves, such as sleeve 620, each with sleeve openings, such as sleeve opening 630, distal sleeve opening 631*a* and proximal sleeve opening 631*b*. Sleeve 620 may be connected to the front portion 610 and back portion 650. Garment 600 additionally includes gussets, such as 640. Gusset 640 may bridge between the front portion 610 and the back portion 650. Each gusset may have a gusset front portion and a gusset back portion. For instance, gusset 640 may have a gusset front portion 642 and a gusset back portion 644 that may allow gusset 640 to run continuously from front portion 610 of garment 600 to back portion 650 of garment 600 and span across portions of sleeve 620. In some aspects, gusset front portion 642 and/or gusset back portion 644 may span across portions of sleeve opening 630. For further discussion, reference will be made to reference numbers of FIG. 6, however the discussion may apply to various aspects of the present invention. A gusset, such as gusset 640, may be configured in various manners. In certain exemplary aspects, gusset 640 may be connected to a front portion 610 and back portion 650 of a garment 600 without connecting to sleeve 620 and/or sleeve opening 630. In other aspects, a gusset 640 may be connected to front portion 610, back portion 650, sleeve 620 and sleeve opening 630. Further, a substantial portion of gusset 640 may be connected to a substantial portion of sleeve 620 and sleeve opening 630.

In some exemplary aspects gusset 640 may span across a substantial length of the front portion 610 and/or back portion 650 of garment 600. In other exemplary aspects, a majority of the front portion 610 and back portion 650 may not include a substantial length of gusset 640. A gusset may comprise one continuous piece of material or two or more pieces of materials. Additionally, gusset 640 may be shaped in various forms. Gusset 640 may take on the shape of a rectangle, triangle, rhombus or any other type of shape. The shape of gusset 640 may depend on the type of shoulder pads garment 600 may be configured to be worn over. Specifically, the shape of gusset 640 may be based on and correspond to the shape and/or configuration of a negative space of a shoulder pad. The shape and/or performance of a gusset may be influenced by a shoulder pad, the material comprising the gusset, and seam construction attached to the gusset. For instance, a gusset comprising material with a large modulus of elasticity may allow for more stretching and range of motion than a gusset comprising material with a small modulus of elasticity. Further, the shape and/or performance of a gusset may be influenced by a type of sport and type of athlete and/or activities a wearer may engage in. For example, in the field of football, a quarterback player may be required to extend a throwing arm upwards, backwards and forwards in order to throw a ball. However, a defensive tackle player may be primarily required to extend an arm forward in order to make a tackle. Because the range of motion for a quarterback player is broader than the range of motion of a defensive tackle player, the type of material, elastic modulus, seam construction, and other aspects of a gusset configuration may be different for a quarterback player than a defensive tackle player. Specifically, the elastic modulus of a gusset may be greater for a quarterback player than for a defensive tackle player.

Additionally, a gusset may form an articulation region 690 of a garment and/or a sleeve. An articulation region may be a region that experiences movements in a variety of directions. In some aspects, an articulation region may correspond to a negative space between a back panel and a front panel. In further aspects, an articulation region may correspond a negative space, such as negative spaces 240 and 242 of FIG. 2 and/or between a back portion and shoulder pads, such as shoulder pads 320 and 322, as shown in FIG. 3.

In some aspects, a garment, such as garment 600 may have a plurality of edges, such as seams between panels and/or portions. Garment 600 may have a first seam edge 680 that may be located between at least a portion of a front panel and at least a portion of gusset 640. The first seam edge 680 has a first end 680*a* and a second end 680*b*, such that the first seam edge 680 joins the gusset 640 to at least a first portion of the front panel, the first end 680*a* being located inferior to the second end 680*b* when garment 600 is in the as-worn configuration, where an inferior portion of the distal short sleeve opening is positioned superior to the first seam edge 680. Garment 600 further comprises a second seam edge 681 having a third end 681*a* and a fourth end 681*b*, the second seam edge 681 joining the gusset 640 to at least an anterior portion of the sleeve panel when garment 600 is in the as-worn configuration. Garment 600 may further comprise a third seam edge 682 that may be located between at least a portion of a back panel and at least a portion of gusset 640. The third seam edge 682 joins gusset 640 to at least a portion of the back panel, and further comprises a fifth end 682*a* being located inferior to a sixth end 682*b*, wherein the fifth end 682*a* of the third seam edge 682 intersects the first end 680*a* of the first seam edge 680 at a location inferior to the short sleeve to form a first point 670, wherein the first point 670 is positioned posterior to an intersection of a first dotted line 699 and a second dotted line 698. An intersection (also described above as the first point) 670 may be an intersection between the first seam edge 680 and the third seam edge 682. For reference purposes the first dotted line 699 running from an area proximate a front top portion toward a front bottom portion is provided and the second dotted line 698 running from a front panel toward a back panel is provided. Intersection 670 may be located at an area posterior a sleeve opening, such as sleeve opening 630. Intersection 670 may be located posterior first dotted line 699 and inferior second dotted line 698. Finally, garment 600 may comprise a fourth seam edge 683 having a seventh end 683*a* and an eighth end 683*b*, the fourth seam edge 683 joining gusset 640 to at least a posterior portion of the sleeve panel, wherein the eighth end 683*b* of the fourth seam edge 683 intersects the sixth end 682*b* of the third seam edge 682.

Additionally, gussets may be constructed of a textile with beneficial stretch properties to facilitate movement of a wearer of a garment in accordance with the present invention, particularly the wearer's arms. Textiles used to construct gussets for garments in accordance with the present invention may permit stretching along one or two axes. In other words, a gusset textile may permit enhanced stretch capabilities in two opposing directions or in four directions. A four-way stretch textile may provide the greatest amount of flexibility and freedom of movement for a wearer of a garment in accordance with the present invention, but a two-way stretch gusset may provide sufficient enhanced mobility at an advantageous cost while providing support for an athlete along the gusset's non-stretching axis. If a two-way stretch textile is used for a gusset, the gusset may be oriented such that the textile of the gusset is oriented to permit maximum stretch in a desired direction, such as to permit the wearer's arms to be raised, to permit a throwing motion, etc. A single garment may combine different types of gussets, with different stretch properties, and/or oriented differently with regard to the stretch axes of those gussets.

Referring now to FIG. 7, a portion of an exemplary garment 700 is shown, in accordance with aspects herein. Garment 700 comprises a front portion 710 connected to a back portion (not shown). Garment 700 also includes sleeves, such as sleeve 720. Each sleeve may have a distal sleeve opening and a proximal sleeve opening. A distal sleeve opening may be more anterior than a proximal sleeve opening allowing for the sleeve to be an anterior-oriented sleeve in an at-rest configuration. Garment 700 may have a distal sleeve opening 730 and a proximal sleeve opening 731. Distal sleeve opening 730 may be more anterior than proximal sleeve opening 731 allowing for distal sleeve opening 730 to be more anterior-oriented than proximal sleeve opening 731 in an at-rest configuration. As used herein, an at-rest configuration may be when a garment is not being worn by a wearer and/or when a garment is not being manipulated by a wearer or any other person and/or object. Further, garment 700 may include gussets, such as gusset 740. Sleeve 720 may be connected to the front portion 710 and back portion. Distal sleeve opening 730 may be configured to be at an angle directed towards the front of garment 700 as described above such that distal sleeve opening 730 may be more anterior than proximal sleeve opening 731.

In some exemplary aspects, a back portion 770 of sleeve opening 730 may be wider than front portions 760 of sleeve opening 730. In some aspects, garment 700 may have a first edge 782 that may be located between at least a portion of a first panel and gusset 740. Garment 700 may also have a second edge 783 that may be located between a sleeve panel and gusset 740. Gusset 740 may be located anterior to a sleeve opening, such as sleeve opening 730 and/or 732. Garment 700 may have an intersection 771 that may be located anterior a sleeve opening such as sleeve opening 730. In some aspects, garment 700 may be similar to garment 600 of FIG. 6 and comprise a first intersection 670. In some aspects, intersection 771 may be located anterior line 699 and superior line 698 such that lines 698 and 699 represent a location relative to the sleeve opening 630 of FIG. 6. Additionally, intersection 771 may be located anterior and superior intersection 670.

FIG. 8 shows a portion of an exemplary garment 800, in accordance with aspects herein. Garment 800 comprises a front portion (not shown) connected to a back portion 850. Garment 800 also includes sleeves, such as sleeve 820 with sleeve opening 830. Sleeve 820 may be connected to the front portion and back portion 850. Sleeve opening 830 may be configured at an angle towards the front of garment 800. Generally, sleeve 820 may be of any length. For instance, sleeve 820 may be configured to span a length of a user's arm.

Figure 9:
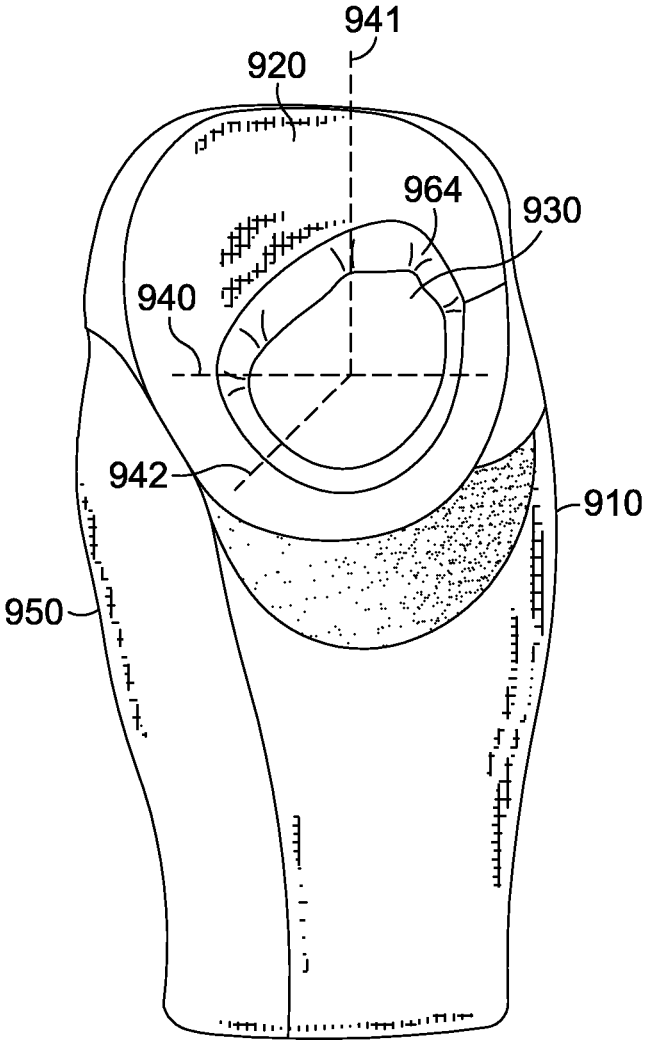
FIG. 9 is a side perspective view of an exemplary embodiment of an optimal range of motion garment, in accordance with aspects herein.

FIG. 9 shows a portion of an exemplary garment 90, similar to garment 700 of FIG. 7 and garment 800 of FIG. 8, in accordance with aspects herein. Garment 900 comprises a front portion 910, back portion 950, sleeve 920, sleeve opening 930. For reference purposes in describing the various angles associated with a sleeve opening, an x-axis 940, y-axis 941 and z-axis 942 has been shown within sleeve opening 930 of garment 900. Sleeve opening 930 may be rotated around y-axis 941 along a plane associated with the x-axis 940 and z-axis 942 up to 180 degrees. Additionally, in some exemplary aspects, sleeve opening 930 may be rotated around x-axis 942 along a plane associated with the y-axis 941 and z-axis 942 up to 180 degrees. The angles of a sleeve opening and other aspects of the sleeve opening may be influenced by a shoulder pad, type of sport, type of athlete, type of activities a user may engage in and a motion of an arm.

Figure 10:
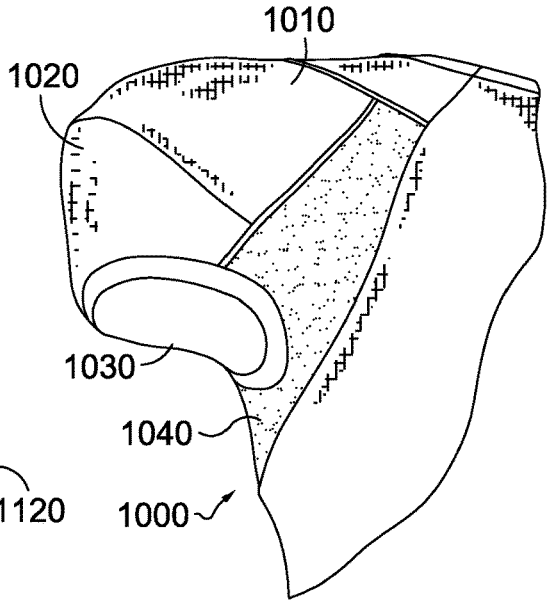
FIG. 10 is a perspective view of an exemplary embodiment of an optimal range of motion garment, in accordance with aspects herein.

Referring now to FIG. 10, a portion of an exemplary garment 1000 is shown. Garment 1000 is shown fitted over shoulder pads, similar to shoulder pads 300 and garment 1000 comprises a back portion (not shown) connected to a front portion 1010, and includes sleeve 1020 with sleeve opening 1030. Sleeve 1020 may be connected to the back portion and front portion 1010. Garment 1000 additionally includes gussets, such as gusset 1040. Gusset 1040 may bridge between the back portion and the front portion 1010. FIG. 10 shows garment 1000 fitted over a set of shoulder pads, such as shoulder pads 300 of FIG. 300. Gusset 1040 corresponds to a negative space of a shoulder pad, such as negative space 340 of shoulder pad 300 of FIG. 3. Gusset 1040 may comprise characteristics similar to those of gusset 430 of garment 400 of FIG. 4, gusset 530 of garment 500 of FIG. 5, and gusset 630 of garment 600 of FIG. 6. Specifically, gusset 1040 may be configured at various angles to correspond with a negative space of shoulder pads and/or other similar garments. Sleeve opening 1030 may comprise characteristics similar to those of sleeve openings 730 of garment 700 of FIG. 7, 830 of garment 800 of FIG. 8, and 930 of garment 900 of FIG. 9. Specifically, sleeve opening 1030 may be rotated around a y-axis along a plane associated with an x-axis and z-axis up to 180 degrees. Additionally, in some exemplary aspects, sleeve opening 1030 may be rotated around the x-axis along a plane associated with the y-axis and z-axis up to 180 degrees. Sleeve opening 1030 may be configured to rotate in a direction towards the front of a user. Additionally, sleeve opening 1030 may be located substantially more on the front portion than on the back portion 1050.

Figure 11:
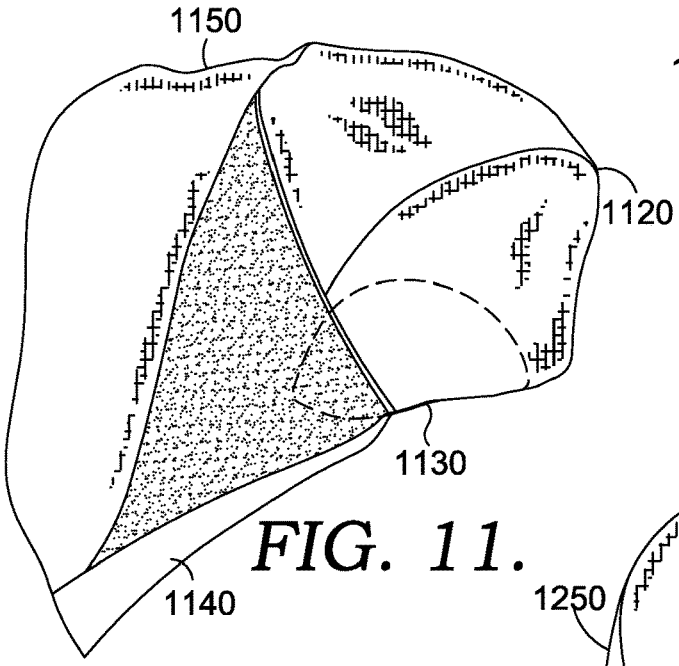
FIG. 11 is a perspective view of an exemplary embodiment of an optimal range of motion garment, in accordance with aspects herein.

FIG. 11 shows a portion of an exemplary garment 1100, similar to garment 1000, as fitted over a set of shoulder pads, similar to shoulder pads 300 of FIG. 3, in accordance with aspects herein. Garment 1100 comprises a front portion connected to a back portion 1150. Garment 1100 also includes sleeve 1120 with sleeve opening 1130 (dotted line). Sleeve 1120 may be connected to the front portion and back portion 1150. Garment 1100 additionally includes gusset 1140. Gusset 1140 may bridge between the front portion and the back portion 1150. Gusset 1140 may comprise characteristics similar to those of gusset 430 of garment 400, 530 of garment 500, and 630 of garment 600 shown in FIGS. 4, 5, and 6, respectively. Specifically, gusset 1140 may be configured at various angles to correspond with negative spaces of shoulder pads and/or other similar garments. Sleeve opening 1130 may comprise characteristics similar to those of sleeve openings 730 of garment 700, 830 of garment 800, and 930 of garment 900, as shown in FIGS. 7, 8, and 9, respectively. Specifically, sleeve opening 1130 may be rotated around a y-axis along a plane associated with an x-axis and z-axis up to 180 degrees. Additionally, in some exemplary aspects, sleeve opening 1130 may be rotated around the x-axis along a plane associated with the y-axis and z-axis up to 180 degrees. Sleeve opening 1130 may be configured to rotate in a direction towards the front of a user. Additionally, sleeve opening 1130 may be located substantially more on the front portion than on the back portion 1150.

Figure 12:
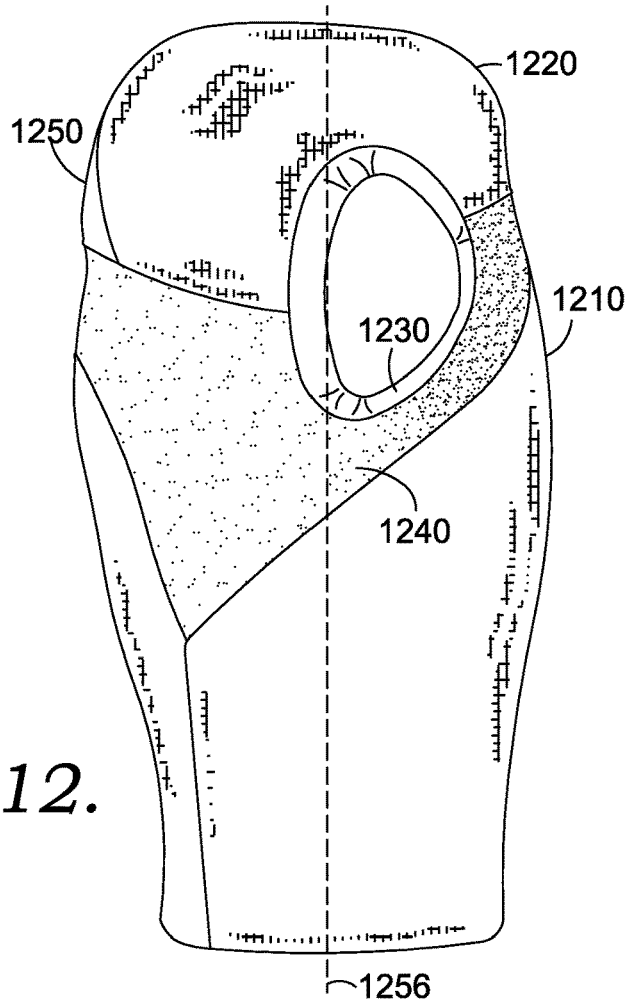
FIG. 12 is a side perspective view of an exemplary embodiment of an optimal range of motion garment, in accordance with aspects herein.

FIG. 12 provides a perspective view of a portion of an exemplary garment 1200, similar to garment 1100 of FIG. 11, as fitted over a set of shoulder pads, similar to shoulder pads 300 of FIG. 3, in accordance with aspects herein. Garment 1200 comprises a front portion 1210 connected to a back portion 1250. Garment 1200 also includes a sleeve 1220 with sleeve opening 1230. Sleeve 1220 may be connected to the front portion 1210 and back portion 1250. Garment 1200 additionally includes a gusset 1240. Gusset 1240 may comprise characteristics similar to those of gusset 430 and 432 of garment 400, 530 and 532 of garment 500, and 630 and 632 of garment 600 shown in FIGS. 4, 5, and 6, respectively. Specifically, gusset 1240 may be configured at various angles to correspond with negative spaces of shoulder pads and/or other similar garments. Sleeve opening 1230 may comprise characteristics similar to those of sleeve opening 730 of garment 700, 830 and 832 of garment 800, and 930 and 932 of garment 900, as shown in FIGS. 7, 8, and 9, respectively. Specifically, sleeve opening 1230 may be rotated around a y-axis along a plane associated with an x-axis and z-axis up to 180 degrees. Additionally, in some exemplary aspects, sleeve opening 1230 may be rotated around the x-axis along a plane associated with the y-axis and z-axis up to 180 degrees. Sleeve opening 1230 may be configured to rotate in a direction towards the front of a user. Additionally, sleeve opening 1230 may be located substantially more on the front portion 1210 than on the back portion 1250.

To further describe the placement of sleeve opening 1230, an axis 1256 is provided as a reference, representing a midline between the front portion 1210 and back portion 1250. Looking at FIG. 12, a larger portion of sleeve opening 1230 is located on the anterior side of axis 1256 than one the posterior side of axis 1256, such that a larger portion of sleeve opening 1230 is located on the front portion 1210 than one the back portion 1250.

Generally, for further discussion of exemplary aspects of the present invention, a sleeve opening, such as sleeve opening 1230, may be placed at a variety of locations in relation to front portion 1210 and back portion 1250. Sleeve opening 1230 may be placed halfway (½) between front portion 1210 and back portion 1250, thereby being centered. Sleeve opening 1230 may be placed one-third (⅓) of the way between front portion 1210 and back portion 1250, with the majority of sleeve opening being located closest to front portion 1210. There are numerous locations sleeve opening 1230 may be placed at, such as but not limited to, one-fourth, one-fifth, one-sixth or one-sixteenth, or any amount there between, of the way between front portion 1210 and back portion 1250.

In combining both sleeve opening 1230 and gusset 1240 into one garment, several combinations of gusset angles, sleeve opening angles, sleeve placements and sleeve lengths are possible. In various exemplary aspects, a garment may be customized to fit a user based on the combination of gusset angles, sleeve opening angles, sleeve placements and sleeve lengths in order to provide the user with an optimal range of motion based on a user's specific measurements, type of athlete, type of activities, type of sport, motion of arms, type of shoulder pads, preferences and various other aspects associated with the garment.

As described in reference to exemplary aspects, the present invention allows for a user to obtain an optimal range of motion. From the foregoing, it will be seen that this invention is one well adapted to attain all the ends and objects hereinabove set forth together with other advantages which are obvious and which are inherent to the structure.

As described herein, aspects relate to a garment that provides a user an optimal ranges of motion. Accordingly, one aspect is directed toward an optimal range of motion garment capable of fitting over one or more shoulder pads. The garment comprises a front portion attached to a sleeve, a back portion attached to the sleeve, and a gusset attached to the front portion and the back portion, the gusset being configured to correspond to a negative space of the one or more shoulder pads facilitating an optimal range of motion for a user.

Another aspect may be directed towards an optimal range of motion garment capable of fitting over one or more shoulder pads. The garment comprises a front portion attached to a sleeve, a back portion attached to the sleeve, and a sleeve opening attached to the sleeve, the sleeve opening being directed towards the front of a user at a specific angle, facilitating an optimal range of motion for the user.

In yet another aspect, an optimal range of motion garment capable of fitting over one or more shoulder pads may be provided. The garment comprises a front portion attached to a sleeve, a back portion attached to the sleeve, a gusset attached to the front portion and the back portion, and a sleeve opening attached to the sleeve, the sleeve opening being directed towards the front of a user at a specific angle, wherein the gusset and sleeve opening being directed towards the front portion at a specific angle facilitate optimal range of motion for the user.

It will be understood that certain features and subcombinations are of utility and may be employed without reference to other features and subcombinations. This is contemplated by and is within the scope of the claims. Since many possible exemplary aspects may be made of the invention without departing from the scope thereof, it is to be understood that all matter herein set forth or shown in the accompanying drawings is to be interpreted as illustrative and not in a limiting sense.

Having thus described the invention, what is claimed is:

1. An enhanced mobility shirt comprising:

a front panel and an opposite back panel, wherein at least a portion of the front panel is connected directly to at least a portion of the opposite back panel;

a sleeve panel connected to at least a portion of the front panel and at least a portion of the back panel to form at least a superior portion of a short sleeve when the enhanced mobility shirt is in an as-worn configuration, the short sleeve comprising a proximal short sleeve opening and a distal short sleeve opening, wherein at least a portion of the front panel is located posterior to the distal short sleeve opening when the shirt is in the as-worn configuration;

a first phantom line that extends vertically such that the shirt is generally bisected into front and back halves;

a second phantom line that extends horizontally, such that the first phantom line and the second phantom line intersect within a circumference defined by the distal short sleeve opening;

a gusset connected between at least a portion of the front panel, at least a portion of the back panel, and at least a portion of the sleeve panel to form at least an inferior portion of the short sleeve when the shirt is in the as-worn configuration, the gusset defined by a plurality of seam edges, the gusset comprising:

a first seam edge having a first end and a second end, the first seam edge joining the gusset to at least a first portion of the front panel, the first end being located inferior to the second end when the shirt is in the as-worn configuration, wherein an inferior portion of the distal short sleeve opening is positioned superior to the first seam edge;

a second seam edge having a third end and a fourth end, the second seam edge joining the gusset to at least an anterior portion of the sleeve panel when the shirt is in the as-worn configuration;

a third seam edge having a fifth end and a sixth end, the third seam edge joining the gusset to at least a portion of the back panel, the fifth end being located inferior to the sixth end, wherein the fifth end of the third seam edge intersects the first end of the first seam edge at a location inferior to the short sleeve to form a first point, wherein the first point is positioned posterior to an intersection of the first phantom line and the second phantom line; and a fourth seam edge having a seventh end and an eighth end, the fourth seam edge joining the gusset to at least a posterior portion of the sleeve panel, wherein the eighth end of the fourth seam edge intersects the sixth end of the third seam edge.

2. The enhanced mobility shirt of claim 1, wherein the front panel comprises a front top portion, a front bottom portion, a front first side portion, and a front second side portion, and wherein the back panel has a back top portion, a back bottom portion, a back first side portion, and a back second side portion.

3. The enhanced mobility shirt of claim 2, wherein the proximal short sleeve opening is connected to at least a portion of the front top portion and at least a portion of the back top portion and defines at least a portion of the proximal short sleeve opening of the short sleeve.

4. The enhanced mobility shirt of claim 3, wherein the gusset is connected to at least a portion of the front top portion, at least a portion of the front first side portion, at least a portion of the back top portion, at least a portion of the back first side portion, and at least a portion of the sleeve panel and defines at least a portion of the proximal short sleeve opening of the short sleeve and at least a portion of the distal short sleeve opening of the short sleeve.

5. The enhanced mobility shirt of claim 4, wherein the gusset is configured to correspond to a negative space of a shoulder pad.

6. The enhanced mobility shirt of claim 4, wherein the gusset forms an articulation region of the short sleeve.

7. The enhanced mobility shirt of claim 1, wherein a second point is located superior to a central point of the distal short sleeve opening of the short sleeve.

8. The enhanced mobility shirt of claim 1, wherein the distal short sleeve opening is more anterior than the proximal short sleeve opening allowing for the short sleeve to be an anterior-oriented sleeve in an at-rest configuration.

9. An enhanced mobility shirt comprising:

a front panel and an opposite back panel, wherein at least a portion of the front panel is connected directly to at least a portion of the opposite back panel;

a sleeve panel connected to at least a portion of the front panel and at least a portion of the back panel and forms at least a first portion of a sleeve, the sleeve comprising a proximal sleeve opening and a distal sleeve opening, wherein the distal sleeve opening is more anterior than the proximal sleeve opening allowing for the sleeve to be an anterior-oriented sleeve in an as-worn configuration;

a first phantom line that extends vertically such that the shirt is generally bisected into front and back halves;

a second phantom line that extends horizontally such that the first phantom line and the second phantom line intersect within a circumference defined by the distal sleeve opening;

a gusset connected between at least a portion of the front panel, at least a portion of the back panel, and at least a portion of the sleeve panel to form at least an inferior portion of the sleeve when the shirt is in the as-worn configuration, the gusset defined by a plurality of seam edges, the gusset comprising:

a first seam edge having a first end and a second end, the first seam edge joining the gusset to at least a first portion of the front panel, the first end being located inferior to the second end when the shirt is in the as-worn configuration;

a second seam edge having a third end and a fourth end, the second seam edge joining the gusset to at least an anterior portion of the sleeve panel when the shirt is in the as-worn configuration;

a third seam edge having a fifth end and a sixth end, the third seam edge joining the gusset to at least a portion of the back panel, the fifth end being located inferior to the sixth end, wherein the fifth end of the third seam edge intersects the first end of the first seam edge at a location inferior to the sleeve to form a first point, wherein the first point is positioned posterior to the intersection of the first phantom line and the second phantom line; and a fourth seam edge having a seventh end and an eighth end, the fourth seam edge joining the gusset to at least a posterior portion of the sleeve panel, wherein the eighth end of the fourth seam edge intersects the sixth end of the third seam edge.

10. The enhanced mobility shirt of claim 9, wherein the front panel comprises a front top portion, a front bottom portion, a front first side portion, and a front second side portion, and wherein the back panel has a back top portion, a back bottom portion, a back first side portion, and a back second side portion.

11. The enhanced mobility shirt of claim 10, wherein the sleeve is connected to at least a portion of the front top portion and at least a portion of the back top portion and defines at least a portion of the proximal sleeve opening of the sleeve or at least a portion of the distal sleeve opening of the sleeve.

12. The enhanced mobility shirt of claim 11, wherein the gusset is connected to at least a portion of the front top portion, at least a portion of the front first side portion, at least a portion of the back top portion, at least a portion of the back first side portion, and at least a portion of the sleeve panel and defines at least a portion of the proximal sleeve opening of the sleeve or at least a portion of the distal sleeve opening of the sleeve.

13. The enhanced mobility shirt of claim 12, wherein the gusset is configured to correspond to a negative space of a shoulder pad.

14. The enhanced mobility shirt of claim 12, wherein the gusset forms an articulation region of the sleeve.

15. The enhanced mobility shirt of claim 11, wherein the sleeve panel comprises a first sleeve panel and a second sleeve panel, wherein the first sleeve panel is connected to at least a portion of the front panel, at least a portion of the back panel, and at least a portion of the gusset, and wherein the second sleeve panel is connected to at least a portion of the gusset and at least a portion of the first sleeve panel.

* * * * *